US005746336A

United States Patent [19]

Edwards

[11] Patent Number: 5,746,336

[45] Date of Patent: May 5, 1998

[54] COUPLER ADAPTOR FOR MODEL RAILROAD ROLLING STOCK

[75] Inventor: Lawrence D. Edwards, Eagle Point, Oreg.

[73] Assignee: Kadee Quality Products Co., White City, Oreg.

[21] Appl. No.: 679,699

[22] Filed: Jul. 11, 1996

[51] Int. Cl.[6] ..... B61G 7/00

[52] U.S. Cl. ..... 213/75 TC

[58] Field of Search ..... 213/75 R, 75 TC, 213/19, 20, 21

[56] References Cited

U.S. PATENT DOCUMENTS

| | | | |
|---|---|---|---|
| 2,107,024 | 2/1938 | Bonanno | 213/74 |
| 2,184,103 | 12/1939 | Rydin | 213/100 |
| 2,303,731 | 12/1942 | Ferri | 213/75 TC |
| 2,574,630 | 11/1951 | Edward et al. | 213/212 |
| 3,397,483 | 8/1968 | Lingard | 46/216 |
| 3,469,713 | 9/1969 | Edwards et al. | 213/75 TC |
| 3,605,332 | 9/1971 | Stepek | 46/216 |
| 4,512,483 | 4/1985 | Crossley et al. | 213/75 |
| 4,768,663 | 9/1988 | Schuller | 213/75 TC |
| 5,316,158 | 5/1994 | Dunham et al. | 213/20 |

FOREIGN PATENT DOCUMENTS

| | | | |
|---|---|---|---|
| 1257716 | 2/1961 | France | 213/75 TC |
| 3723025 | 1/1989 | Germany | 213/75 TC |
| 4020756 | 6/1990 | Germany | A63H 19/19 |

*Primary Examiner*—Mark T. Le
*Attorney, Agent, or Firm*—Robert D. Varitz

[57] ABSTRACT

A coupler adaptor is intended for use with rolling stock that has a coupler mounted thereon, and is used between the coupler mount and a coupler draft box having a coupler mounted therein. The adaptor includes an adaptor plate having a post thereon. A spring is provided and has opposed, extensible arms, and draft-box capturing fingers located at the ends of the arms. A spring coil is located intermediate the arms and is sized to fit over the post. When the individual elements are combined, the coupler may rotate relative to the draft box and the draft box may rotate relative to the adaptor plate, which is fixed on the rolling stock, thereby providing for significantly greater angular movement of the coupler than what would otherwise be possible.

11 Claims, 2 Drawing Sheets

COUPLER ADAPTOR FOR MODEL RAILROAD ROLLING STOCK

BACKGROUND OF THE INVENTION

The invention relates to model railroad rolling stock, and specifically to a coupler adaptor for use on model railroad rolling stock, which coupler adaptor is suitable to allow the use of a conventional coupler and draft box on a long locomotive or long car.

Model railroads, as the name suggests, are scale models of prototype railroads. Individuals who build and use model railroads are model railroaders. A complete model railroad includes a track layout, a power source, which is usually electric, non-powered rolling stock, and at least one engine or locomotive, referred to as powered rolling stock. The layout has defined borders, inside of which model railroad track is arranged as desired.

Because model railroad layouts are often found in private homes, the layouts are often quite small. Layouts often incorporate short radius curves, because short radius curves allow more complicated track patterns to be built in smaller spaces.

Model rolling stock is a scale model version of prototype railroad rolling stock, and includes trucks that both roll on the track and are rotatably attached to the bottom of the body, or chassis, of the rolling stock. This is true whether the rolling stock powered, in the case of a locomotive, or non-powered, as in the case of various forms of railroad cars. Each end of the rolling stock is equipped with a coupler structure. Coupler structures allow a unit of rolling stock to be connected to an adjacent unit of rolling stock on the same track. By connecting a number of rolling stock units, and placing a locomotive at one end of the series, a model train is formed.

Coupler structures for use on model railroad rolling stock are designed to appear as realistic as possible. Prototype coupler structures include a knuckle, a shank, and a coupler head. Thus, model railroad coupler structures also include a knuckle, a shank, and a coupler head.

The knuckle and coupler head are designed to mate with similarly-shaped knuckles and coupler heads, thereby providing the coupling effect necessary to link two units of rolling stock together. The shank is attached to the knuckle and coupler head to form a coupler mechanism. The length of this shank provides the necessary space between the rolling stock units. The shank usually is pivoted about a vertical axis, allowing two units of rolling stock to move laterally relative to each other without exerting excessive, derailing lateral forces through the couples. The draft box is attached to the rolling stock body, or to the rolling stock truck, and is designed to retain the shank on the rolling stock. The draft box provides a limited angular motion of the shank relative to the rolling stock. The draft box usually includes an enclosed structure having walls, an opening through which the shank is inserted, a fastener to attach the shank to the draft box, and a centering spring to center the shank relative to the draft box. Thus, when two units of rolling stock are placed on a straight section of track, the knuckles of each rolling stock will align with each other so that when the rolling stock are forced together, the knuckles mate. In this situation, the center line, or longitudinal axis, of the rolling stock overlays the centerline of the track.

The coupler structure just described works well on prototype, and on most model railroads, but has limitations on some model railroads, particularly where small radius curves are provided, and even more particularly, where long rolling stock units, generally in excess of 60 scale feet in length, are placed on such small radius curves. Long rolling stock units require large radius curves to perform properly, because when a long rolling stock unit passes through a curve, the ends of the rolling stock, outboard of the vertical axis of rotation of the truck, shifts away from the centerline of the track. This is because the pivot points of the rolling stock trucks are located some distance from the end of the rolling stock. As the length of the rolling stock increases, the distance between the ends of the unit and the truck pivot point increases, causing the rolling stock centerline at the end of the rolling stock to shift further away from the centerline of the track. Because the coupler mechanism has both limited angular motion relative to rolling stock body, and a limited shank length, long rolling stock units passing through a short radius curve will experience lateral forces, which are induced by the coupler, which will result in the derailment of the rolling stock. The coupler mechanism reaches limits of its angular motion before the end of the rolling stock extends far enough to accommodate the curve. Derailment may also occur on short-radius S-curves as well. Thus, long rolling stock units are only used on large radius curves in prototype railroads, and are similarly restricted in model railroads.

As previously noted, however, in model railroads, it is frequently desired to use long rolling stock units on short radius curves because model railroad layouts are commonly constructed with short radius curves in order to put as much track as possible on a layout to make train operation more interesting. While the model railroader could easily accommodate the small radius curves by restricting rolling stock to those of short length, generally less than 60 scale feet in length, most model railroaders prefer to be able to use a wide variety of rolling stock. It is thus required that long rolling stock units which are intended for use on such layout, be equipped with coupler structure which permit greater angular motion than the prototype coupler structure.

Couplers on prototype railroads are located on the rolling stock chassis at each end thereof. This is true of most model rolling stock units, however, in some instances, the coupler is mounted on the truck to avoid the problem of derailments that occur when a long scale model rolling stock unit attempts to negotiate a small radius curve. While this technique is effective to lessen the derailment problem, such construction is not based on prototypical designs, and is unacceptable to serious model railroaders.

A known technique for provided the added angular motion necessary to use long rolling stock on short radius curves is to attached a coupler mechanism, which includes a knuckle, shank, and draft box, to a coupler sub-frame, which is mounted concentrically with the vertical axis of the truck, and pivots about the attachment point for the truck. This particular technique, however, requires that the coupler subframe be precisely sized to match the length of the rolling stock unit, because the distance from the end of the rolling stock to the attachment point for the truck varies with the particular model. Such a subframe generally will match the geometry of a particular manufacturer's truck, thus limiting the usefulness of the technique because of the numerous parameters involved in various styles and designs of rolling stock trucks. This particular coupler mechanism mounting scheme frequently results in derailment-producing lateral forces when a train which includes rolling stock units negotiates a small radius curve, an S-curve or travels over a turnout. The problem is aggravated when such train is backed through such maneuvers. In addition, such mechanisms are unacceptable to serious model railroaders, because they are not prototypical, nor do they appear to be prototypical.

Another technique for solving the aforementioned problems is disclosed in our prior U.S. Pat. No. 5,316,158, for Coupler Structure for Model Trains with Centering Cavity and Surfaces. In that patent, an improved coupler structure is shown, which includes a conventional coupler which is mounted on a coupler mount, which is in turn attached to the underside of the unit of a rolling stock chassis. The coupler structure disclosed therein allows the coupler to pivot relative to the coupler structure, and allows pivoting and centering of the coupler structure relative to the rolling stock. While suitable for use on long pieces of non-powered rolling stock, or on the back end of a locomotive, neither this structure, nor none of the other known modifications are suitable for use as a coupler located on the front of a locomotive. The front of a locomotive is quite visible to anybody watching the locomotive, and is generally provided with a coupler mount located on the front end of the locomotive, which is usually an internal structure, located within a locomotive body. As such, the structure shown in our '158 patent is not suitable for use on the front end of a locomotive, nor is it practical to use a mounting which pivots coaxially with the locomotive truck.

An object of the invention is to provide a model railroad coupler adaptor which will provide for increased angular motion for a coupler.

Another object of the invention is to provide a coupler adaptor which may be easily attached to an existing coupler mount on the body of model railroad rolling stock.

A further object of the invention is to provide a coupler structure that attaches to the body of a model railroad rolling stock of any length, design, style or regardless of what manner of trucks are used thereon.

Still another object of the invention is to provide a coupler adaptor which is self-centering and which may be easily retrofit on to existing model railroad rolling stock units. A further object of the invention is to provide a coupler adaptor that provides increased angular motion that is aesthetically pleasing to a model railroader.

Another object of the invention is to provide a coupler adaptor which has improved performance for backing long-rolling stock units through small-radius curves.

SUMMARY OF THE INVENTION

The coupler adaptor of the invention is intended for use with rolling stock that has a coupler mounted thereon, and is used between the coupler mount and a coupler draft box having a coupler mounted therein. The adaptor includes an adaptor plate having a post thereon. A spring is provided and has opposed, extensible arms, and draft-box capturing fingers located at the ends of the arms. A spring coil is located intermediate the arms and is sized to fit over the post. When the individual elements are combined, the coupler may rotate relative to the draft box and the draft box may rotate relative to the adaptor plate, which is fixed on the rolling stock, thereby providing for significantly greater angular movement of the coupler than what would otherwise be possible.

These and other objects and advantages of the invention will become more fully apparent as the description that follows is read in conjunction with the drawings.

BEST MODE OF PRACTICING THE INVENTION

Figure 1:
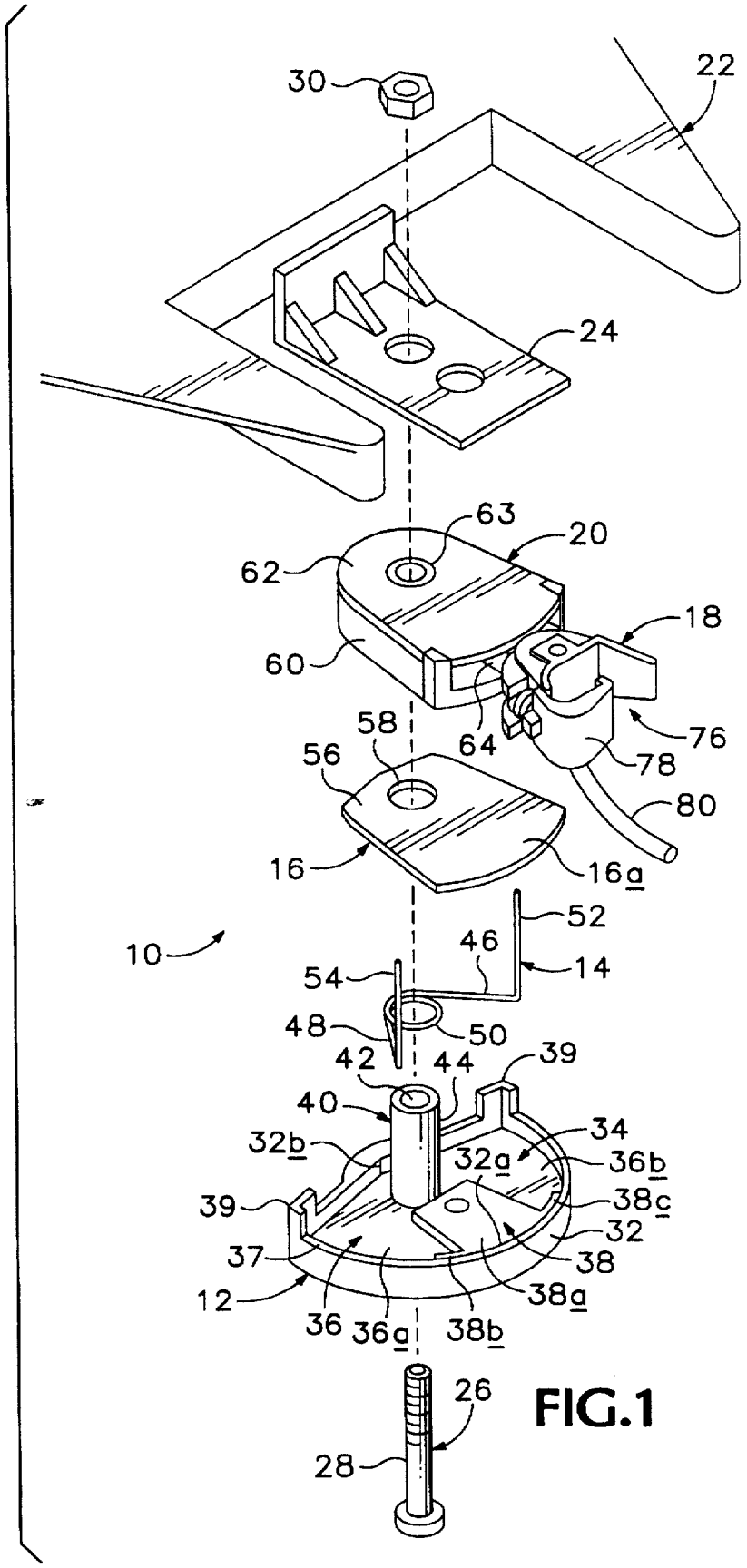
FIG. 1 is an exploded, perspective view of the coupler adaptor of the invention.

Turning now to the drawings, and initially to FIG. 1, a coupler adaptor for use on model railroad rolling stock is depicted generally at 10. Coupler adaptor 10 includes an adaptor plate, shown generally at 12, a spring 14 and a spring retainer 16. Adaptor 10 is designed to work with a conventional coupler 18, which is mounted in a draft box 20. Coupler adaptor 10, draft box 20 and coupler 18 are secured to a model railroad rolling stock chassis 22, and specifically to a coupler mount 24 by means of a coupler fastener 26. Fastener 26, in the preferred embodiment, includes a bolt 28 and a nut 30, although, depending on the specific configuration of coupler mount 24, other types of fasteners may be suitable for use in this application.

As previously noted, one application of the coupler adaptor of the invention is for use on the front of a long locomotive. The configuration depicted in FIG. 1 for chassis 22 is typical of the chassis and coupler mount which would be found on such a locomotive.

Figure 2:
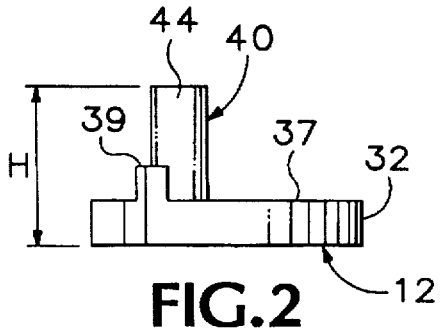
FIG. 2 is side elevation of an adaptor plate of the invention.
Figure 3:
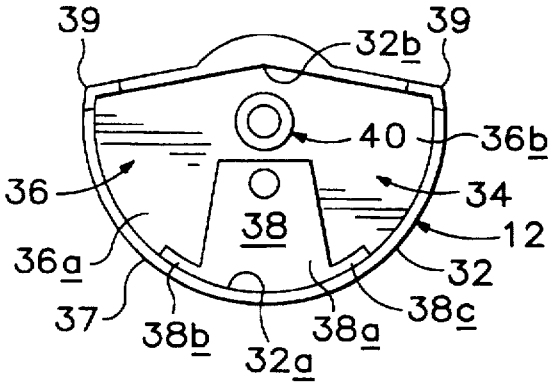
FIG. 3 is a top-plan view of the adaptor plate of FIG. 2.

Referring now to FIGS. 2–3, the individual components will be described in greater detail. Adaptor plate 12 includes a base 32, which in the preferred embodiment has a semi-circular configuration, having a forward, curved edge **32*a*, and a rear, peaked edge 32*b*. A spring receiver 34 is located in base 32, and, in the preferred embodiment, includes a wasted area 36, having mirror image regions 36*a*, 36*b* therein. A rim 37 extends about the periphery of wasted area 36. A platform 38 is located in base 32, and is raised above the lever of wasted area 36. Platform 38 includes a central portion 38*a*, and a pair of flanges 38*b*, 38*c* which extend from either side thereof along the forward, curved edge 32*a* of base 32. Platform 38 provides a seat for spring retainer 16. Receiver 34 is also referred to herein as a draft box centering mechanism receiver. A draft-box angular travel limiter 39 is located on each side of base 32**.

An adaptor plate post, or spring post, 40 is located on base 32, and, in the preferred embodiment is a cylindrical-shaped structure. Spring post 40 includes a cylindrical bore 42 extending therethrough, which, in the preferred embodiment, is sized to receive bolt 28 therein. The outside 44 of post 40 is sized to receive draft box 20 there over. Spring post 40 has a height H, which is sized to provide a stand-off between base 32 and coupler mount 24 such that draft box 20 may be received loosely between base 32 and coupler mount 24, with adaptor plate 12 snugly, non-rotatably, fastened to coupler mount 24 so that draft box 20 may pivot relative to the adaptor plate and the coupler mount, while the adaptor plate is secured so as not to rotate.

Referring now to FIG. 1, spring 14 includes a pair of opposed, extensible arms, 46, 48, and a coil 50, which is sized to fit over spring post 40 and is located intermediate arms 46, 48. A pair of opposed, upright fingers 52, 54, are located at the ends of arms 46, 48, respectively. Fingers 52 and 54 are operable to capture draft box 20 therebetween. Spring 14 is operable, along with adaptor plate 12, to provide a centering mechanism for draft box 20. The centering mechanism causes draft box 20, and in turn, coupler 18, to be placed in a centered position relative to chassis 26.

Referring now to FIGS. 1 and 3, spring retainer 16 includes a plate 56 having a bore 58 located therein. Spring retainer 16 is configured to be received within wasted area 36 to abut the forward, curved edge 32*a* and rear, peaked edge 32*b*, and to overlay 38, including flanges 38*a*, 38*c*, thereby providing a space between base 32 and spring retainer 16 to allow free movement of spring 14 therebetween, in what is referred to herein as a clear region. The upper surface 16*a* of spring retainer 16 is flush with the upper surface of rim 37 when spring retainer 16 is received on base 32. Platform 38 and its associated flanges provide a stable base for spring retainer 16, which in turn provided a stable base for draft box 20, such that draft box 20 may easily rotate relative to adaptor plate 12 and spring retainer 16.

Figure 4:
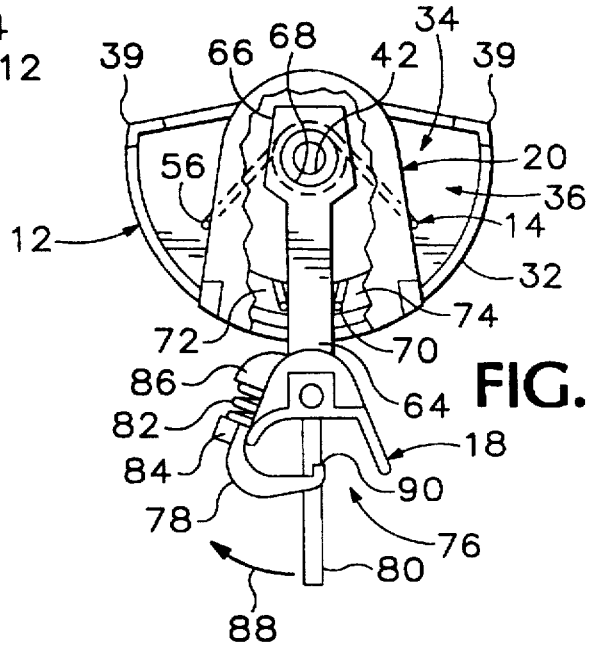
FIG. 4 is a top-plan view of the adaptor plate having a draft box and coupler mounted thereon.
Figure 5:
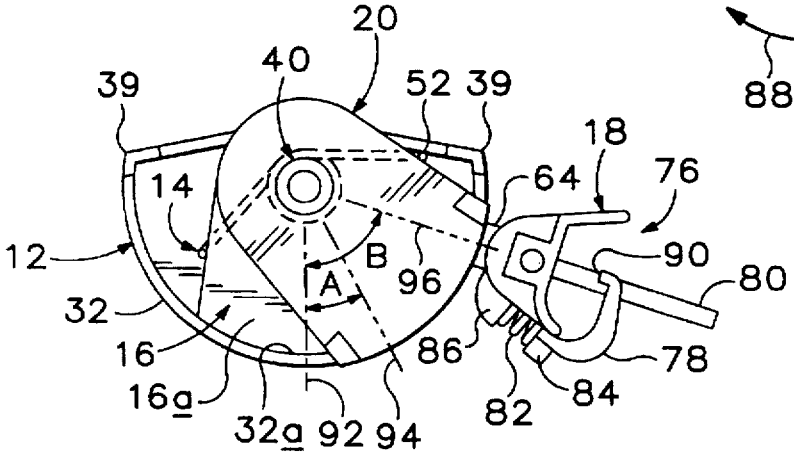
FIG. 5 is a top-plan view of the structure of FIG. 4, with the coupler and draft box shifted to their extreme angular displacements.

Referring now to FIGS. 1, 4 and 5, the details of draft box 20 and coupler 18 will be more fully described. Draft box 20 includes a draft box base 60 and a draft box cover 62. A post 63 extends outwards from base 60. Post 63 has a bore extending therethrough. Spring post 40 outer side 44 is sized snugly to fit into the bore in post 63. As depicted in the drawings, the draft box is of the type which is used with the Kadee Quality Products Company Series 30 couplers. This series of couplers is well known to model railroaders, and is specifically designed for mounting in the coupler pockets on model railroad locomotives.

Coupler 18 includes a shank 64, which is received within draft box 20. Shank 64 has a broadened region 66 at the rear end thereof. Region 66 has a bore 68 therethrough which bore is received on draft box post 63. Bore 68 has an axis about which coupler 18 rotates relative to draft box 20.

Coupler 18 is centered within draft box 20 by means of a torsion spring 70 which is located in a compartment on the lower portion of draft box 20, which compartment is not shown for the sake of clarity in the drawings and because the structure of this compartment is well-known to those of ordinary skill in the art. A pair of slots 72, 74, are located in draft box base 60 and allow the fingers of torsion spring 70 to protrude therethrough into the compartment which receives shank 64.

Coupler 18 includes a coupler head 76, which is located at the other end of shank 64. A coupler knuckle 78 is rotatably attached to coupler head 76 by means of a combination pivot pin/trip pin 80, which is fixed to knuckle 78 and which rotates therewith. As assembled, the rotary movement of draft box 20 is coaxial with that of coupler 18.

Trip pin 80 is designed to simulate an air hose, which would be found on prototype rolling stock for providing a continuous air connection between all of the units of a train. In the model version of coupler 18, trip pin 80 is composed of a ferrous metal, which will cause the knuckle to open when trip pin 80 is brought within an appropriate magnetic field. Knuckle 78 is generally urged toward a close position, as depicted in FIG. 4, by a knuckle spring 82, which coacts with a knuckle dog 84, located on knuckle 78 and a head dog 86, located on coupler head 76.

As is well known to those skilled in the art of model railroading, when the coupler depicted in FIGS. 1, 4 and 5, comes with an appropriate magnetic field, trip pin 80 will be urged, by the magnetic field, in the direction of arrow 88. If coupler 18 is in a relaxed state with respect to an adjoining coupler, trip pin 80 and knuckle 78 will swing, simultaneously, in the direction of arrow 88, thereby releasing one rolling stock unit from the adjacent rolling stock unit. In the event that the adjoining couplers are under tension, knuckle tab 90 will abut the like knuckle tab on an adjoining coupler, and the couplers will remain connected.

Referring now to FIG. 5, the position of coupler 18 and draft box 20 in a centered position is depicted by dash-dot line 92. Coupler 18 is able to swing through an arc, designated by angle A, which extends between line 92 and dash-double-dot line 94, which angle represents the maximum angular displacement of coupler 18 within draft box 20. When draft box 20 is mounted on coupler adaptor 10, coupler 18 may swing through angle B, to a position indicated by dash-triple-dot line 96, which represents the extreme angular displacement of coupler 18 relative to adaptor plate 12 and coupler mount 24. Angle B, in the preferred embodiment, is more than twice angle A, allowing for a much greater angular displacement of coupler 18 relative to the rolling stock chassis on which it is mounted.

To accommodate a variety of rolling stock configuration, adaptor 10, draft box 20 and coupler 18 may be mounted in a variety of configurations on a coupler mount located on a model railroad rolling stock chassis or body. In the embodiment depicted herein, the adaptor plate is located under draft box 20, and both the adaptor plate and the draft box are located on the lower side of a coupler mount located on the chassis. Depending on the height of a coupler mount on the chassis, it may be necessary to mount adaptor plate 12 and draft box 20 on top of the coupler mount, and/or provide a coupler which has a shank configuration so as to raise or lower coupler head 76 to a predetermined height. In the case of coupler standards established for model railroads by the National Model Railway Association (NMRA), coupler 18 has a minimum clearance of 25/64 inches above the top of the rails. Trip pin 80 should clear the rail top by 1/32 inch. To accomplish this, coupler 18 may be constructed so that the shank 64 is underset, centerset or overset on coupler head 76 to provide the greatest possible flexibility in having the horizontal center of coupler head 76 at the precise height of the rails.

Once the proper configuration of coupler 18 is provided on chassis 22, the rolling stock unit containing chassis 22 may be joined with other pieces of rolling stock and may successfully negotiate small radius curves without being derailed by lateral coupler forces. The angle of displacement of coupler 18 relative to its mount is increased from the normal displacement of approximately 30 degrees (Angle A) to an angular displacement of approximately 80 degrees (Angle B).

As depicted in FIGS. 1, 4 and 5, spring retainer plate 56 is constructed and arranged to conform to the dimensions of draft box 20 so that spring 14 will precisely center draft box 20 on plate 56. This is to insure that spring fingers 52, 54 are simultaneously in contact with the sides of plate 56 and the sides of draft box 20 when the draft box is centered. Plate 56 limits the travel of the spring finger located on the side opposite a turn when the draft box is drawn off-center.

Thus, a coupler adaptor for model railroad rolling stock has been disclosed which enables rolling stock having lengths in excess of 60 scale feet to be joined together and to successfully negotiate small radius curves.

Although a preferred embodiment of the invention has been disclosed herein, it should be appreciated that further variations and modifications may be made thereto without departing from the scope of the invention as defined in the appended claims.

I claim:

1. A coupler adaptor on model railroad rolling stock with a coupler and draft box, wherein the rolling stock includes a coupler mount thereon, wherein the coupler includes a coupler head, a knuckle and a shank, and is moveable relative to the draft box about an axis located at one end of the shank, the coupler adapter comprising:

an adaptor plate having:

a draft box centering mechanism receiver, and an adaptor plate post; and a centering mechanism received in said draft box centering mechanism receiver for biasing the draft box on said adaptor plate to a centered position, wherein said adaptor plate is constructed and arranged to provide rotary movement of the draft box relative to the coupler mount, and wherein the rotary movement of the draft box is coaxial with the rotary movement of the coupler.

2. The invention of claim 1 wherein said adaptor plate includes a spring receiver therein and wherein said centering mechanism includes a spring sized to be received in said spring receiver, said spring having opposed, extensible arms, draft-box-capturing fingers located at the ends of said arms, and a coil, located intermediate said arms, sized to fit over said adaptor plate post.

3. The invention of claim 2 which further includes a spring retainer and wherein said spring receiver includes a wasted area in said adaptor plate, and which further includes a platform which provides a seat for said spring retainer.

4. The invention of claim 1 wherein said adaptor plate further includes a draft box angular travel limiter for limiting the angular travel of the draft box relative to said adaptor plate.

5. The invention of claim 1 which includes a coupler fastener for securing the coupler, draft box and said adaptor plate to the coupler mount and wherein said adaptor plate post is sized to receive said coupler fastener on the inside thereof, and wherein said adaptor plate post has a height sufficient to provide a stand-off for said adaptor plate from coupler mount with draft box inserted therebetween to allow free rotational movement of the draft box relative to the coupler mount.

6. A coupler adaptor for use with a coupler and draft box, for model railroad rolling stock, operable to allow the coupler to shift to an extreme angular displacement position greater than that of the coupler movement within the draft box, wherein the rolling stock includes a coupler mount thereon, wherein the coupler includes a coupler head, a knuckle and a shank, wherein the shank has a bore through one end thereof and is received in the draft box, and wherein the draft box also has a bore therethrough and carries a coupler centering spring therein, comprising:

an adaptor plate having:

a spring receiver, a spring post, a spring retainer sized to be received within said spring receiver; and a draft box centering mechanism including a spring which is sized to be received in said spring receiver, having:

opposed, extensible arms, draft-box-capturing fingers located at the ends of said arms, and a coil, located intermediate said arms, sized to fit over said spring post;

a coupler fastener to secure the coupler, draft box and said adaptor plate to the coupler mount;

wherein, with said spring located in said spring receiver, the bore in the draft box and in the shank are aligned with one another and the draft box and shank are placed over said spring post, with one of said fingers located on either side of the draft box thereby to center the draft box on said adaptor plate.

7. The coupler adaptor of claim 6 wherein said adaptor plate further includes a draft box angular travel limiter for limiting the angular travel of the draft box relative to said adaptor plate.

8. The coupler adaptor of claim 6 wherein said adaptor plate post is sized to receive said coupler fastener on the inside thereof and is sized to receive the draft box bore on the outside thereof, and wherein said adaptor plate post has a height sufficient to provide a stand-off for said adaptor plate from coupler mount with draft box inserted therebetween to allow free rotational movement of the draft box relative to the coupler mount.

9. A coupler adaptor for use with a coupler and draft box, for model railroad rolling stock, wherein the rolling stock includes a coupler mount thereon, wherein the coupler includes a coupler head, a knuckle and a shank, wherein the shank has a bore through one end thereof and is received in the draft box, and wherein the draft box also has a bore therethrough and carries a coupler centering spring therein, comprising:

an adaptor plate having:

a spring receiver, having a wasted area therein, and a raised platform therein, and a cylindrical spring post having a cylindrical bore extending axially therethrough, wherein said spring post is sized to receive the draft box bore on the outside thereof and is sized to provide stand-off for adaptor plate from coupler mount with draft box inserted therebetween, a spring retainer which is received in said spring receiver and seats on said platform thereby providing a clear region between said adaptor plate and said spring retainer;

a draft box angular travel limiter for limiting the angular travel of the draft box relative to said adaptor plate; and a spring, sized to be received in said clear region between said spring receiver and said spring retainer, having:

opposed, extensible arms, draft-box-capturing fingers located at the ends of said arms, and a coil, located intermediate said arms, sized to fit over said spring post;

wherein, with said spring located in said clear region, the bore in the draft box and in the shank are aligned with one another and the draft box and shank are placed over said spring post, with one of said fingers located on either side of the draft box thereby to center the draft box on said adaptor plate.

10. The coupler adaptor of claim 9 wherein said adaptor plate further includes a draft box angular travel limiter for limiting the angular travel of the draft box relative to said adaptor plate.

11. The coupler adaptor of claim 9 which includes a coupler fastener for securing the coupler, draft box and said adaptor plate to the coupler mount, and wherein said adaptor plate post has a height sufficient to provide a stand-off for said adaptor plate from coupler mount with draft box inserted therebetween to allow free rotational movement of the draft box relative to the coupler mount.

* * * * *